US005624111A

United States Patent [19]

Maass

[11] Patent Number: 5,624,111

[45] Date of Patent: Apr. 29, 1997

[54] DEVICE FOR ALIGNING SHEETS AT THE FRONT LAYS OF A SHEET PROCESSING MACHINE

[75] Inventor: Burkhard Maass, Heidelberg, Germany

[73] Assignee: Heidelbeger Druckmaschinen AG, Heidelberg, Germany

[21] Appl. No.: 536,960

[22] Filed: Sep. 29, 1995

[30] Foreign Application Priority Data

Oct. 1, 1994 [DE] Germany ..... 44 35 263.8
Jul. 13, 1995 [DE] Germany ..... 195 25 549.6

[51] Int. Cl.[6] ..... B65H 9/04; B65H 9/16

[52] U.S. Cl. ..... 271/236; 271/245; 271/250; 271/253

[58] Field of Search ..... 271/236, 237–238, 271/245, 246, 247, 250, 252, 253, 272–274

[56] References Cited

U.S. PATENT DOCUMENTS

| | | | |
|---|---|---|---|
| 3,190,644 | 6/1965 | Schewebel | 271/245 X |
| 3,663,011 | 5/1972 | Mowry et al. | 271/236 |
| 4,227,685 | 10/1980 | Fischer | 271/252 X |
| 4,470,349 | 9/1984 | Godlewski | 271/246 X |
| 4,591,143 | 5/1986 | Jeschke . | |

FOREIGN PATENT DOCUMENTS

| | | | |
|---|---|---|---|
| 0120349 | 10/1984 | European Pat. Off. . | |
| 1411791 | 8/1965 | France | 271/246 |
| 839644 | 5/1952 | Germany . | |
| 947798 | 8/1956 | Germany . | |
| 4241795 | 6/1994 | Germany . | |
| 81842 | 3/1990 | Japan | 271/245 |
| 2266296 | 10/1993 | United Kingdom . | |

*Primary Examiner*—Boris Milef
*Attorney, Agent, or Firm*—Herbert L. Lerner; Laurence A. Greenberg

[57] ABSTRACT

Device for correctly-registered feeding of sheets supplied thereto in a sheet stream in a sheet transport direction, to front lays of a sheet-processing machine having a lateral pulling device, and a sheet-advancing device disposed within a smallest format width to be processed. The feeding devices includes at least one permanently driven drive roller disposed in the vicinity of the front lays, and at least one contact pressure device cooperatively engageable with the at least one drive roller. The drive roller has a rotational axis directed crosswise to the sheet transport direction, and at least part of the drive roller is disposed laterally of the sheet advancing device.

9 Claims, 4 Drawing Sheets

DEVICE FOR ALIGNING SHEETS AT THE FRONT LAYS OF A SHEET PROCESSING MACHINE

BACKGROUND OF THE INVENTION

Field of the Invention

The invention relates to a device for aligning sheets and, more particularly, for feeding sheets with correct registration in sheet-fed rotary printing presses.

It has become known heretofore to provide sheet aligning means, in a forward region of feeding tables at sheet-fed rotary printing presses, for aligning in lateral and circumferential directions a respective sheet conveyed in a sheet stream, before the sheet is transferred to the printing press. In this regard, a sheet transported on the feeding table by a conveyor device is aligned in the circumferential direction at front lays and, thereafter, are drawn up to laterally disposed side stops by side pull marks. The problem often arises that the sheet is slightly twisted or criss-crossed and no longer rests with correct registration at the front lays.

The published German Patent Document DE 42 41 795 A1, for example, discloses a device for feeding sheets to front lays, wherein a cyclically driven drive roller cooperates with a counterpart roller. A sheet passed between these rollers is thus moved cyclically against front lays both before and after the lateral or side alignment has been performed.

It is disadvantageous that means for cyclic driving have to be provided in the device of the foregoing German publication.

A device has become known heretofore from German Patent 839 644 wherein sheets to be aligned are initially transported by means of two parallel conveyor belts in a direction towards front lays and, close to the feed region, are accepted or taken over by a dabbing device formed of a driven lower roller and an upper roller periodically engageable therewith.

The dabbing device is disposed in an extension of the conveyor belts and consequently has the disadvantage that sheets with a format width greater than that dictated by the spacing of the conveyor belts are moved away from the front lay opposite a respective side pulling device, during a lateral alignment by several side pulling devices, so that registration problems can arise in the sheet feeder.

SUMMARY OF THE INVENTION

It is accordingly an object of the invention to provide a device for feeding sheets with correct registration which avoids the foregoing disadvantages of the heretofore known devices of this general type.

With the foregoing and other objects in view, there is provided, in accordance with the invention, a device for correctly-registered feeding of sheets supplied thereto in a sheet stream in a sheet transport direction, to front lays of a sheet-processing machine having a lateral pulling device, and a sheet-advancing device disposed within a smallest format width to be processed, and comprising at least one permanently driven drive roller disposed in the vicinity of the front lays, and at least one contact pressure device cooperatively engageable with the at least one drive roller, the drive roller having a rotational axis directed crosswise to the sheet transport direction, and at least part of the drive roller is disposed laterally of the sheet advancing device.

In accordance with another aspect of the invention, there is provided a device for correctly-registered feeding of sheets supplied thereto in a sheet stream, to front lays of a sheet-processing machine having a lateral pulling device, and a sheet-advancing device disposed within a smallest format width to be processed, and comprising permanently driven drive rollers disposed in the vicinity of the front lays, and at least one contact pressure device cooperatively engageable with each of the drive rollers, the drive rollers being disposed in a lateral marginal region of the largest format width to be processed and being in continuous operative engagement with the respective contact pressure devices.

In accordance with a further aspect of the invention, there is provided a device for correctly-registered feeding of sheets supplied thereto in a sheet stream along a sheet travel path, to front lays of a sheet-processing machine having a lateral pulling device, and a sheet-conveyor device disposed within a smallest format width to be processed, and comprising at least one permanently driven drive roller disposed in the vicinity of the front lays, at least one contact pressure device cooperatively engageable with the drive roller, the drive roller extending crosswise to the sheet travel path and being formed as a deflecting roller for the sheet-conveyor device laterally of the sheet-conveyor belt.

In accordance with an added aspect of the invention, there is provided a device for correctly-registered feeding of sheets supplied thereto in a sheet stream in a sheet transport direction, to front lays of a sheet-processing machine having a lateral pulling device, and a sheet-advancing device disposed within a smallest format width to be processed, and comprising at least one permanently driven drive roller disposed in the vicinity of the front lays, and at least one contact pressure device cooperatively engageable with the at least one drive roller, the drive roller being a continuous drive roller disposed crosswise to the sheet transport direction, and being disposed in the sheet transport direction between the conveyor belt and the front lays.

In accordance with another feature of the invention, the feeding device includes two of the drive rollers, respectively, having has an axial length extending crosswise to the sheet transport direction up to the sheet advancement devices.

In accordance with a further feature of the invention, the contact pressure device is a freely rotatably supported brush roller.

In accordance with an added feature of the invention, the feeding device includes a crossbar disposed crosswise to the sheet transport direction and being in operative engagement with the lateral pulling device.

In accordance with an additional feature of the invention, the feeding device includes lockable slide elements disposed on the crossbar.

In accordance with yet another feature of the invention, the feeding device includes an adjustable spring element connecting the contact pressure device to one of the slide elements.

In accordance with yet a further feature of the invention, the sheet advancement device is a conveyor belt having a drive, and the drive roller is drivably connected to the conveyor-belt drive.

In accordance with a concomitant feature of the invention, the sheet advancement device is a suction conveyor belt.

An advantage of the feeding device according to the invention is that even during lateral alignment, the permanent transport of the sheet toward the front lays is not interrupted. Due to this provision, twisting or canting of the sheet during lateral alignment is prevented, or at least continuous correction therefore is made. Lengthy pulling paths can thus be traversed, even at high printing speeds, without impairing the quality of the alignment.

In particular, an arrangement of additional drive rollers in the marginal or border regions of sheets having the largest format width to be processed assures a favorable force-application location for advancing the sheet to the front lays.

Another advantage is the saving of space resulting from low structural expenditure, which permits the installation of of the feeding device according to the invention even in small-format printing presses.

The displaceability of the contact roller transversely to the sheet transport direction makes sensitive adjustment, for example, to print-free places, possible.

An arrangement of contact rollers at the side pull lay, which is movable crosswise to the sheet transport direction, permits a simultaneous co-adjustment of the contact rollers during a format adjustment.

An embodiment of the contact roller as a brush roller simplifies a lateral motion of the sheet in the side pulling process.

In a relatively simple manner, the drive for the drive rollers is coupled with the drive for the sheet transport on the feeding table.

In another exemplary embodiment, the deflection rollers for the conveyor belt are constructed, respectively, as drive rollers laterally of the conveyor belt. This makes for a more compact structure.

In yet another exemplary embodiment, a continuous drive roller, which is disposed crosswise to the sheet transport direction and corresponds to the largest format width to be processed, is provided; it is disposed in the sheet transport direction between the conveyor belt and the front lays. As a Due to this provision, the drive roller can be disposed very close to the front lays.

Other features which are considered as characteristic for the invention are set forth in the appended claims.

Although the invention is illustrated and described herein as embodied in a device for aligning sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

BRIEF DESCRIPTION OF THE INVENTION

DESCRIPTION OF THE PREFERRED EMBODIMENTS

Figure 1:
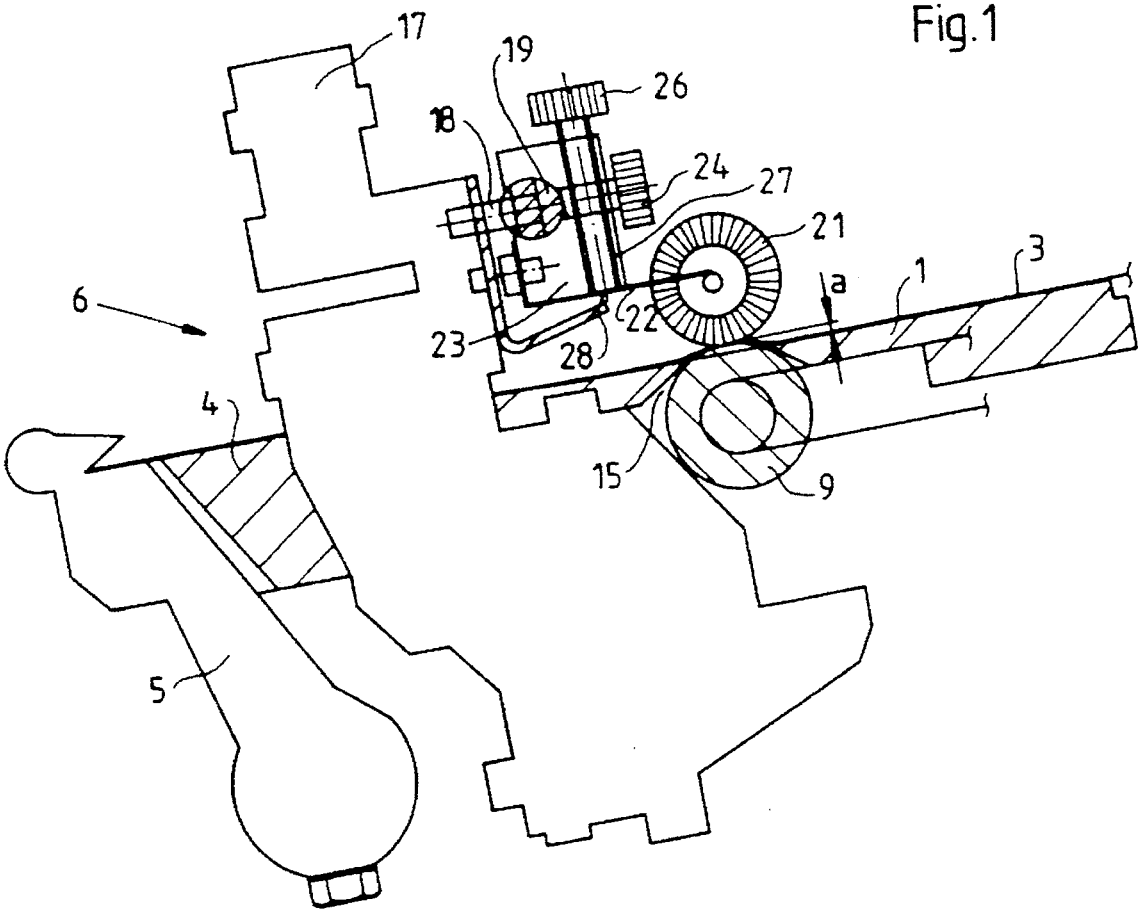
FIG. 1 is a diagrammatic, side elevational view, partly in section, of a device for aligning sheets in accordance with the invention.

Referring now to the drawings, there is shown therein a feeder table 1 of a sheet-fed rotary printing press having spaced-apart front lays 2 and, therebetween, pregrippers 5 to which a sheet 3 to be processed is fed for alignment in the circumferential direction. The feeding table 1 has at least one pulling device 6 in a forward or front region 4 thereof. The puller 6 is movable crosswise, i.e., transversely, to the sheet transport direction for adjusting the format. A conveyor belt 7 provided in the middle of the feeding table 1 is formed with a number of holes 8 which are in communication with a non-illustrated suction device. The conveyor belt 7 extends up close to the front lays 2. Drive rollers 9 are disposed on both sides, respectively, of the conveyor belt 7. The drive rollers 9 extend transversely to the sheet transport direction from a marginal or border region of the greatest normal width of the sheet 3 to be processed up to the conveyor belt 7. The respective drive rollers 9 are rotatably supported or journalled. The disposition of the drive rollers 9 is mirror-symmetrically identical, and therefore only the construction of the drive roller 9 located on the left-hand side of the conveyor belt 7, as viewed in the sheet transport direction, is described hereinbelow.

Figure 2:
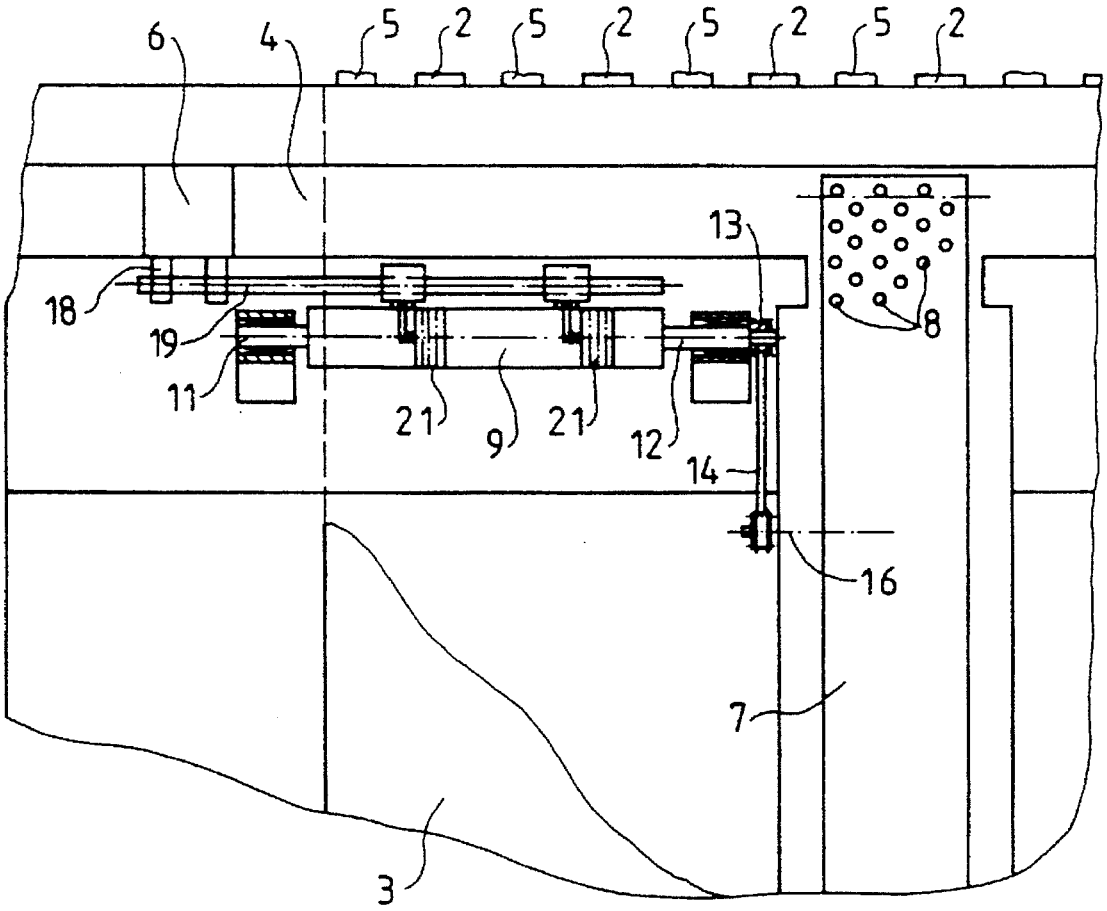
FIG. 2 is a reduced fragmentary plan view of FIG. 1, rotated clockwise through 90° and diagrammatically showing a feeding table in greater detail.

As shown in the embodiment of FIG. 2, the drive roller 9 is supported so as to be drivable rotatably in bearing blocks below the plane of the table 1 by two journal pins 11 and 12. The drive roller 9 passes through an opening 15 formed in the feeding table 1, so that the outer cylindrical surface of the roller 15 is flush with the plane of the table 1 or preferably protrudes above it a small distance a equal to approximately 0.5 to 1 mm. The journal pin 12 carries a pinion 13 which is drivingly connected to a drive belt 14. The drive belt 14 is driven by a shaft 16 which simultaneously serves as the drive means for the conveyor belt 7, so that the drive roller 9 and the conveyor belt 7 have the same conveying speed.

The puller 6 is formed, amongst other components, of a pull lay housing 17 to which a crossbar or traverse 19, which is disposed parallel to the drive roller 9, is secured by clamping bolts or mounting studs 18. A number of contact pressure elements, such as from one to three thereof, which are formed as brush rollers 21, are displaceably disposed on the crossbar 19 transversely to the sheet transport direction. The brush rollers 21 are freely rotatably mounted at an end of a leaf spring 22. The leaf spring 22 is secured to a slide element 23, which is displaceable on the crossbar 19 and can be locked by means of a knurled screw 24.

A second knurled screw 26 is disposed in a continuous threaded bore 27 formed in the slide element 23 and presses with with an end 28 thereof against the leaf spring 22. The adjusting pressure with which the brush roller 21 engages the drive roller 9 is finely adjustable by the knurled screw 26. By suitably displacing the slide element 23 on the crossbar 19, the brush roller 21 is able to be adjusted to engage only print-free areas in the subject.

As shown in the embodiment of FIG. 2, a sheet 3 is transported up to the front lays 2 primarily by means of the conveyor belt 7 and, thereat, aligned by means of the front lays 2 in the circumferential direction. The puller 6 pulls the sheet 3 against the stops provided for lateral alignment. Twisting of the sheet 3 is prevented by the fact that the drive rollers 9 are permanently driven, even during the lateral alignment, and therefore press the sheet 3 constantly against the front lays 2, because a fourth engagement location between the drive rollers 9 and the sheet 3 is located, in particular, in a lateral marginal or border region of the sheet 3. The term "lateral marginal region" is intended to mean the region extending up to a side edge of the sheet on either side of the conveyor belt 7.

Figure 3:
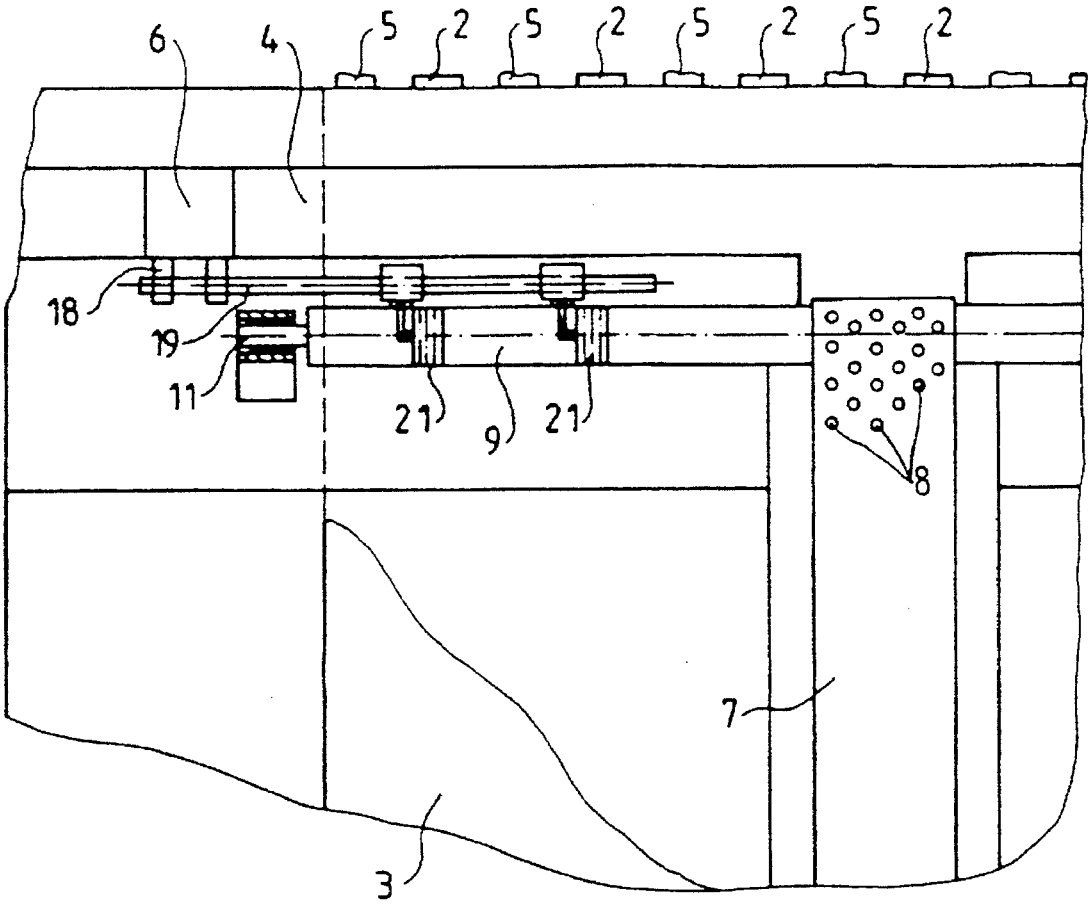
FIG. 3 is view like that of FIG. 2 of another exemplary embodiment of the invention.
Figure 4:
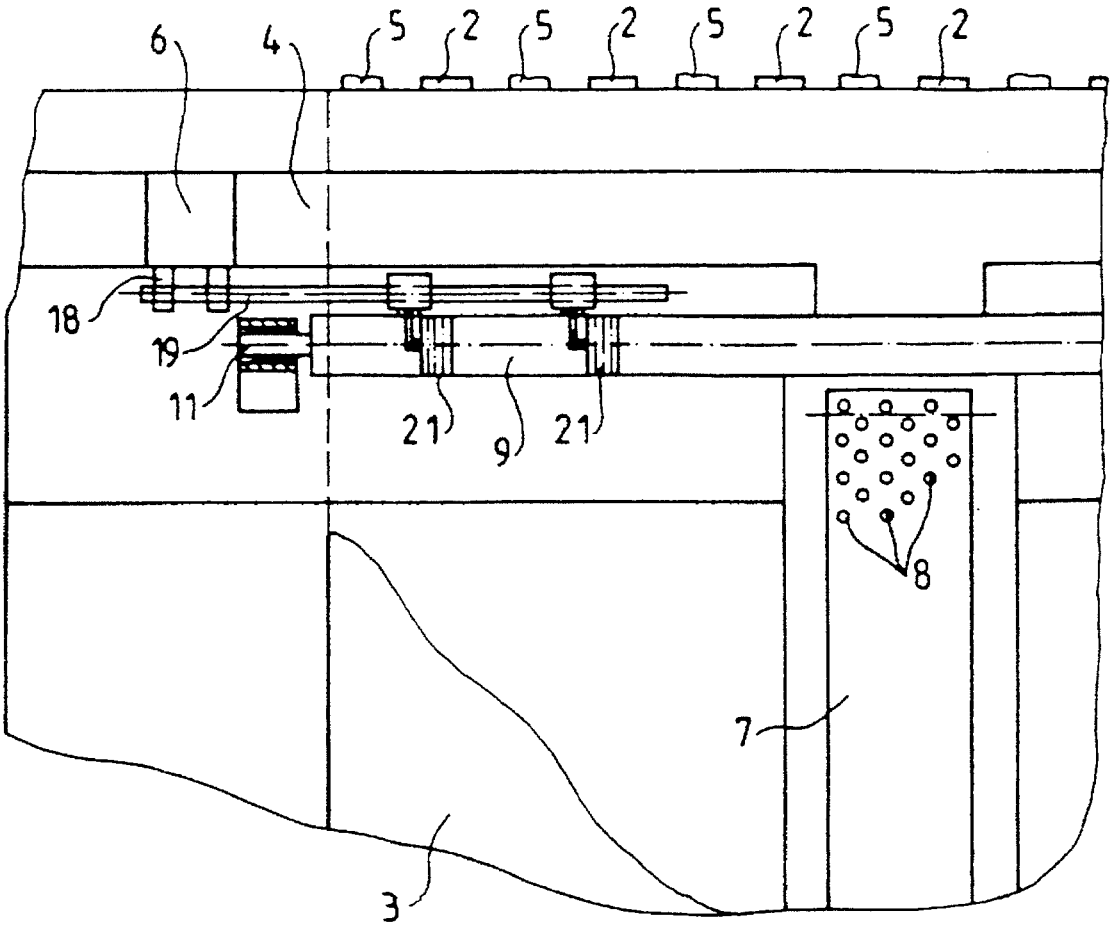
FIG. 4 is another view like those of FIGS. 2 and 3 of a third exemplary embodiment.

In the embodiment of FIG. 3, the drive rollers 9 themselves serve as deflecting rollers for the conveyor belt 7 and, in the embodiment of FIG. 4, the drive roller 9 is a continuous drive roller and is disposed between the front lays 2 and the conveyor belt 7.

I claim:

1. In a sheet-processing machine for processing sheets of a smallest format width and of a largest format width, the sheet-processing machine having front lays and a lateral pulling device, a device for correctly-registered feeding of sheets supplied thereto in a sheet stream in a sheet transport direction, to the front lays of the sheet-processing machine, comprising: a sheet-advancing device disposed within the smallest format width to be processed, at least one permanently driven drive roller disposed in the vicinity of the front lays, and at least one contact pressure device in continuous operative engagement with said at least one drive roller, said drive roller having a rotational axis directed crosswise to the sheet transport direction, and at least part of said drive roller is disposed laterally of the sheet-advancing device.

2. Feeding device according to claim 1, including two of said drive rollers, respectively, having an axial length extending crosswise to the sheet transport direction up to said sheet-advancing device.

3. Feeding device according to claim 1, wherein said contact pressure device is a freely rotatably supported brush roller.

4. Feeding device according to claim 1, including a crossbar disposed crosswise to the sheet transport direction and being in operative engagement with said lateral pulling device.

5. Feeding device according to claim 4, including lockable slide elements disposed on said crossbar.

6. Feeding device according to claim 5, including an adjustable spring element connecting said contact pressure device to one of said slide elements.

7. Feeding device according to claim 1, wherein said sheet-advancing device is a conveyor belt having a drive, and said drive roller is drivably connected to said conveyor belt drive.

8. Feeding device according to claim 1, wherein said sheet-advancing device is a suction conveyor belt.

9. In a sheet-processing machine for processing sheets of a smallest format width and of a largest format width, the sheet-processing machine having front lays and a lateral pulling device, a device for correctly-registered feeding of sheets supplied thereto in a sheet stream, to the front lays of the sheet-processing machine, comprising a sheet-advancing device disposed within the smallest format width to be processed, permanently driven drive rollers disposed in the vicinity of the front lays, and a plurality of contact pressure devices cooperatively engaged with each of said drive rollers, said drive rollers being disposed in a lateral marginal region of the largest format width to be processed and being in continuous operative engagement with the respective contact pressure devices.

* * * * *

UNITED STATES PATENT AND TRADEMARK OFFICE

CERTIFICATE OF CORRECTION

PATENT NO. : 5,624,111

DATED : April 29, 1997

INVENTOR(S) : Burkhard Maass

It is certified that error appears in the above-indentified patent and that said Letters Patent is hereby corrected as shown below:

ON THE TITLE PAGE:

Item (73) should read as follows:

Assignee: Heidelberger Druckmaschinen AG,
Heidelberg, Germany

Signed and Sealed this

Eighth Day of July, 1997

Bruce Lehman

*Attest:*

BRUCE LEHMAN

*Attesting Officer*

*Commissioner of Patents and Trademarks*